United States Patent [19]

Shwayder

[11] 4,450,635

[45] May 29, 1984

[54] LEVEL ADJUSTABLE SKID SHOE FOR PLOW BLADES

[76] Inventor: Warren M. Shwayder, 2335 E. Lincoln, Birmingham, Mich. 48008

[21] Appl. No.: 422,800

[22] Filed: Sep. 24, 1982

[51] Int. Cl.[3] ..... E01H 5/06

[52] U.S. Cl. ..... 37/271; 29/148.3; 29/526 R; 228/189

[58] Field of Search ..... 37/231, 232, 271, 266, 37/270; 172/701.1, 701.3, 832; 29/526 R, 148.3; 228/189

[56] References Cited

U.S. PATENT DOCUMENTS

| | | | |
|---|---|---|---|
| 2,139,625 | 12/1938 | Pruss | 37/270 X |
| 2,933,838 | 4/1960 | Rockwell | 172/832 X |
| 3,011,276 | 12/1961 | Likely | 172/832 X |
| 3,588,147 | 6/1971 | Enters | 37/231 X |
| 4,346,528 | 8/1982 | Schwayder | 37/270 |

FOREIGN PATENT DOCUMENTS

| | | | |
|---|---|---|---|
| 61378 | 8/1926 | Sweden | 37/271 |
| 129656 | 10/1950 | Sweden | 37/271 |

*Primary Examiner*—Edgar S. Burr
*Assistant Examiner*—Moshe I. Cohen
*Attorney, Agent, or Firm*—Cullen, Sloman, Cantor, Grauer, Scott and Rutherford

[57] ABSTRACT

A snow plow blade skid shoe is angularly adjusted during mounting upon the plow moldboard for leveling the shoes ground contacting pad. The shoe includes a pair of spaced apart brackets which are secured to the moldboard by bolts extending through the pre-existing bolt holes used for bolting the plow blade to the moldboard. An elongated shoe pad extends horizontally between the lower edges of the brackets and is initially secured thereto by a bendable connector. Plate-like arms, fastened to the pad, are loosely positioned adjacent the brackets. When the plow mounted blade is initially lowered until its bottom edge engages the ground, the pressure between the pad and ground causes the pad to angularly turn, thereby bending the connector, to level the pad in full face to face contact with the ground and parallel to the blade bottom edge. Then the arms are welded to their adjacent bracket portions for fixing the pad position.

10 Claims, 9 Drawing Figures

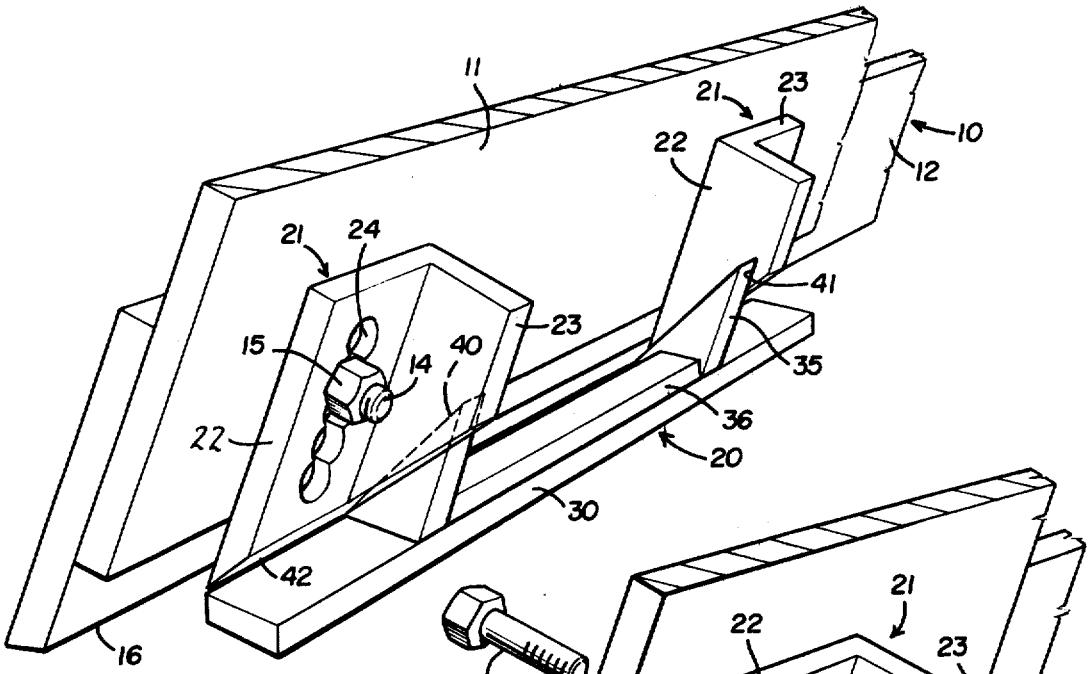
FIG. 1
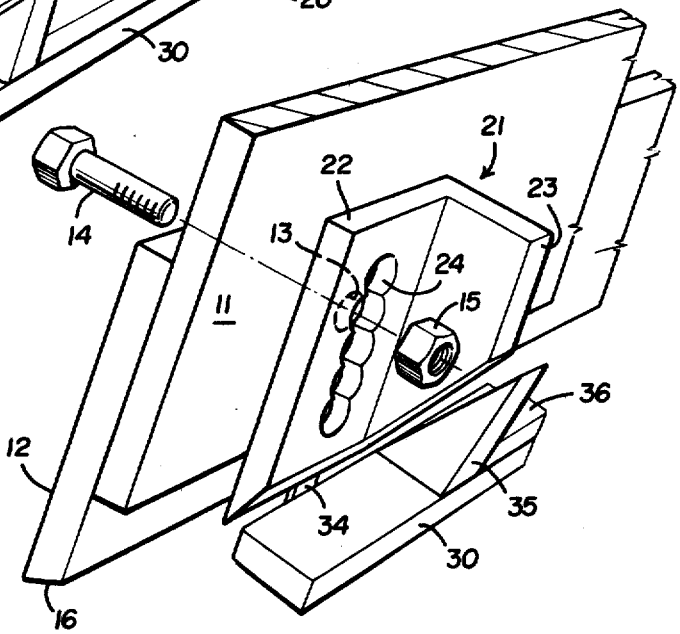
FIG. 2
FIG. 3
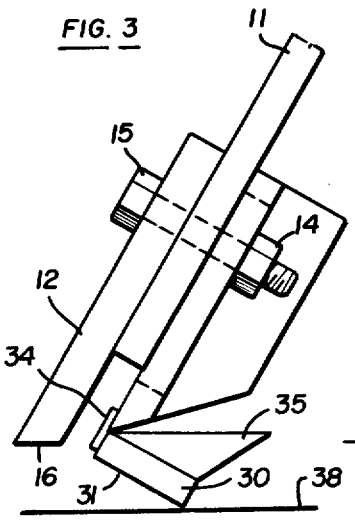
FIG. 4
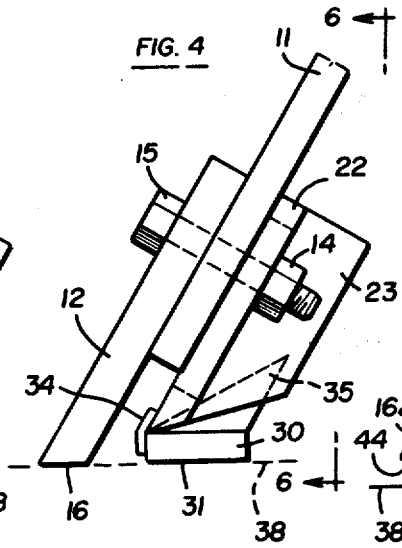
FIG. 5
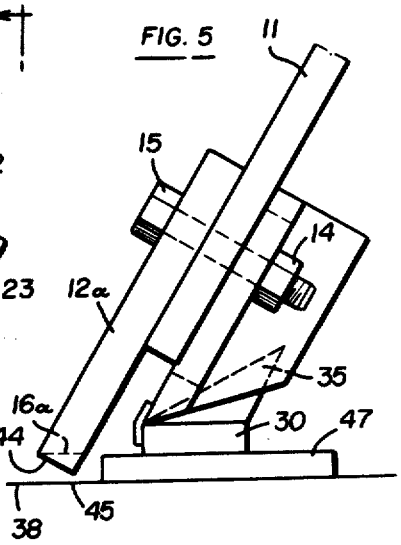

LEVEL ADJUSTABLE SKID SHOE FOR PLOW BLADES

BACKGROUND OF INVENTION

Snow plows are conventionally provided with skid shoes mounted on the lower, rear portions of the plow moldboards in order to support and guide the plow blade lower edge upon or slightly above the ground. One form of skid commonly used comprises a roller or wheel, like a caster, which is mounted upon the rear of the moldboard for rotatably supporting the plow when the plow is lowered into ground engaging position. These caster-like wheels, however, tend to jam in use and thus, flatten, so as to adversely affect their ability to roll. Thus, regular adjustment, lubrication and replacement are required.

Another form of skid shoe conventionally used involves a plate-like pad arranged to engage the ground and connected to the rear of the moldboard by a suitable bracket. Different kinds of plates have been used, including circular ones as well as rectangular shapes. Since the skids tend to wear out, along with the ground contacting surface of the blades, attempts have been made to utilize wear resistant materials for the plates to reduce such wear. Thus, tungsten carbide and other hard carbides have been applied to the bottoms of the pads to resist wear due to the friction resulting from engaging and rubbing upon the ground during plowing.

One example of an improved form of skid, having a bottom surface protected with a wear resistant carbide material is disclosed in my prior patent application, Ser. No. 206,801, filed Nov. 14, 1980 and entitled "Skid Shoe for Snow Plow Blade", now U.S. Pat. No. 4,346,528.

Where a plate-type ground engaging pad on the skid shoe engages the ground, frequently there is uneven wear because the ground engaging surface of the pad or shoe is not level with the ground engaging lower edge of the plow blade. This may happen because the moldboard of the plow is typically arranged at an angle to the vertical, which angle may vary from plow to plow, depending upon the nature of the mounting mechanism and where it is secured to the support vehicle. Even with similar plows having similar mounting equipment, merely by mounting the plows upon different vehicles having different heights of the securement locations may change the angularity of the plow. Further, the plow angles may also be changed by the nature and condition of the plow raising and lowering equipment. Pivoted shoes have been used to try to solve these problems but pivoted shoes cannot dampen vibration or fully absorb shock or even fully support the blade because of the pivot. Pivoted shoes also tend to break loose at the pivot which is a weak link in the structure.

In any event, typically the ground engaging surfaces of the skid shoes or pads of the skid shoes are not in full face to face contact with the ground, that is, they are not truly level with the ground engaging edge of the plow blade so that there is uneven wear which results in excessive wear on the plow blade as well as on the skid.

Thus, the invention herein relates to a skid shoe having a pad which may be angularly adjusted for each particular plow upon which it is mounted so that it is leveled into a parallel relationship, both transversely and longitudinally, with the ground engaging bottom edge of the plow blade.

SUMMARY OF INVENTION

The invention herein contemplates forming a plow skid shoe, with one or two spaced apart angle brackets which may be bolted to the plow moldboard with the same bolts and bolt holes as are used in bolting the plow blade to the moldboard. A wear resistant pad is arranged beneath the brackets and secured to the lower edge of the brackets by means of bendable, stiff hinge-like tabs. Upright arms are secured to the upper surfaces of the pad, with these arms being arranged adjacent the rearwardly extending arms of the brackets.

The foregoing assembly is preferably mounted upon the plow moldboard by means of some of the bolts used for fastening the blade to the moldboard. After mounting, the pad is adjusted into level position relative to the bottom edge of either a worn or new blade. The adjustment is accomplished by lowering the plow, which is mounted upon a vehcile, until the bottom edge of the blade contacts the ground. The pressure, during the lowering, upon the pad, bends or pivots the pad around the tabs until the pad is longitudinally and transversely aligned with the bottom ground engaging edge of the blade. This position is maintained by the stiff tabs which have been bent during the pivoting movement of the pad.

At this point, the installer may remove the assembly from the plow moldboard and weld the adjacent pad arms to the bracket legs and the pad edges to the bracket portions in the vicinity of the tabs to thus form a solid, rigid construction that is custom fitted for that particular plow.

Before removing the assembly from the plow, the installer may tack weld the pad and its arms to the adjacent bracket portions where desired, to insure that the angular relationship is maintained until the final welding step.

Thus, the invention contemplates a skid shoe assembly which is adjustable into leveled position upon the plow with which it will be used, before welding the assembly into its final construction. It also contemplates a method for final assembling a skid shoe assembly so that it is custom fitted to a particular plow, with minimal labor and time required.

An advantage of this construction is that the wear resistant pad of the skid shoe is at all times positioned for full face to face contact with the ground in parallel arrangement relative to the bottom edge of the plow blade so as to minimize wear. That is, the bottom edge of the blade will wear no faster than does the ground engaging surface of the pad which, in turn, will wear relatively slowly because it is formed of a wear resistant material, such as a hard carbide material. Because the uneven wear is eliminated, the full surface to surface contact of the pad against the ground materially increases the life of the assembly and the life of the blade.

By utilizing an installer welded assembly, the skid shoe angularity, relative to the plow blade, is unchanged during use and particularly, during impacts or frictional drag which occurs when the plow is pushed along the ground. Thus, a sturdy, rigid shoe assembly is formed, partially by the manufacturer, and then completed by the installer in a matter of minutes, so that each assembly is custom fitted.

These and other advantages of this invention will become apparent upon reading the following description, of which the attached drawings form a part.

DESCRIPTION OF DRAWINGS

FIG. 1 is a perspective, fragmentary view of one lower corner of a snow plow assembly, with a plow shown schematically.

FIG. 2 is a view similar to FIG. 1, but showing only a portion of the skid shoe, during assembly of the skid shoe upon the plow.

FIG. 3 is a side, elevational view, showing the skid shoe assembly mounted upon the plow, prior to leveling of the skid shoe pad.

FIG. 4 is a view similar to FIG. 3, but illustrating the skid shoe pad in ground alignment with the lower edge of the plow blade.

FIG. 5 is a view similar to FIG. 4, but showing the alignment of the skid shoe pad relative to a square edge, new plow blade.

DETAILED DESCRIPTION

Figure 6:
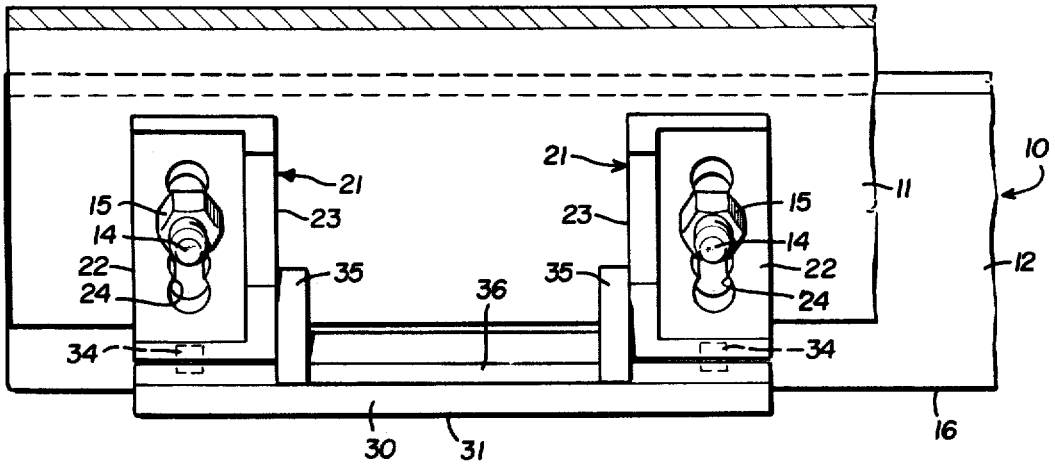
FIG. 6 is an elevation view of the skid shoe assembly mounted upon the lower corner of a plow blade and moldboard assembly, taken in the direction of arrow 6—6 of FIG. 4.
Figure 7:
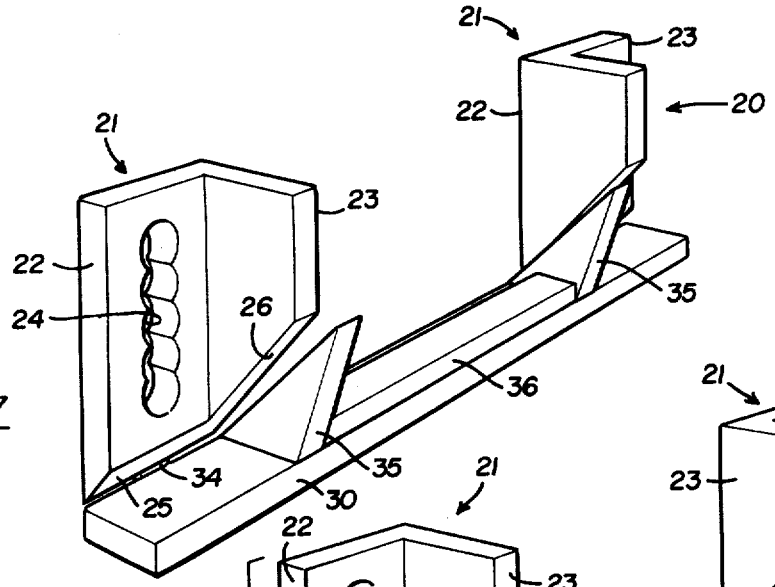
FIG. 7 is a perspective view of the skid shoe assembly per se, prior to alignment of the pad with a plow blade.

Referring to the drawings, a conventional snow plow 10, which is schematically shown, comprises a moldboard 11 and a ground engaging blade 12. A series of aligned holes 13 (see FIG. 2) receive bolts 14 which are fastened by nuts 15. These bolts secure the blade 12, at a number of locations along the width of the plow, to the moldboard. The drawings, for example FIG. 6, shows two such bolts and nuts. However, in a typical plow, the bolts are spaced roughly eight inches apart or twelve inches apart or some such similar distance.

The blade lower edge, ground engaging bottom surface 16 typically is at an angle relative to the plane of the blade due to the fact that the plow is tilted at an angle to the vertical during operation. Thus, the bottom surface is either preformed or else wears to an angle, as shown for example in FIG. 3.

In order to support the plow upon the ground as well as to reduce the wear upon the blade ground engaging bottom surface 16, a skid shoe or the like support is provided. The invention herein relates to an improved skid shoe 20. This shoe is formed of a pair of angle brackets 21, each having a first or attachment leg 22 and a second or angle leg 23.

The angle brackets are fastened to the plow moldboard 11 by utilizing the same bolt holes and the same bolts, if they are long enough, which fasten the plow blade to the moldboard. If the bolts are too short, then they may be replaced with longer bolts. However, by utilizing the pre-existing bolt holes, the installation of the skid shoe is considerably simplified. Thus, as shown in FIG. 2, the bolts 14 extend through the pre-existing holes 13 in the moldboard and blade and through a vertically elongated bolt receiving slot 24 formed in each of the attachment legs 22. The slot 24 may be formed as a series of holes drilled through the leg 22 with the centers of the holes defining a straight vertical line.

The lower edge of each of the bracket attachment legs 22 is chamfered or angled at 25. Likewise, the lower part of the second legs 23 are cut away at an angle to form an angular edge 26.

Figure 9:
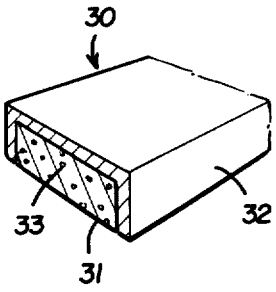
FIG. 9 is a perspective, partially cross-section view, of the pad of the skid shoe.
Figure 8:
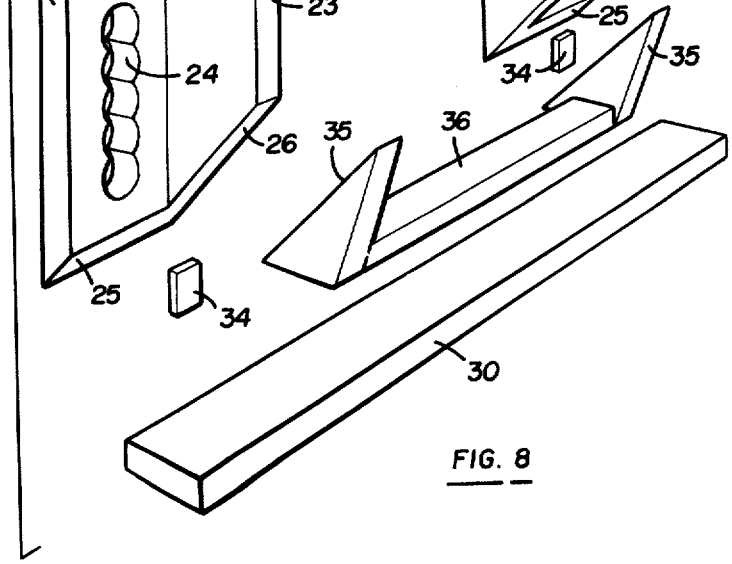
FIG. 8 is a perspective view of the skid shoe parts disassembled.

The skid shoe includes a skid pad 30 which has a lower, ground engaging, face 31. The lower face is provided with a hard, wear resistant material. In the embodiment shown in FIG. 9, the pad may be formed of an envelope or open container 32 filled with a matrix 33 of hard tungsten carbide particles with a bronze binder. The hard particles may be varied, using other commercially available carbides or the like and likewise, the binders can be varied. In addition, the pad, instead of being formed of a single unit, may be formed of a plate of steel upon which are fastened several wear resistant pads of a smaller size, as of the type disclosed, for example, in my above mentioned application Ser. No. 206,801 filed Nov. 14, 1980.

As yet another example, the pad may be an envelope with carbide inserts therein. Thus the particular style or form of wear resistant surfacing used on the pad can be varied and is not critical to the invention herein, so long as it provides the wear resistant function in whatever form it takes.

The pad 30 is secured to the lower edges of the first or attachment legs 22 of the angle brackets 21 by a connecting means. The connecting means may take one of several forms. For example, the connecting means may be an elongated metal strip welded to both the bracket legs and to the pad with the strip being bendable to form a rigid hinge. Mechanical fasteners may also be used. I have illustrated, as the connecting means, a pair of tabs 34. These tabs are preferably formed of a stiff, but bendable, strip material, such as strips of a suitable steel. The tabs may be welded or otherwise secured to each of the bracket legs and the adjacent pad edge.

Triangular shaped arms 35, which are preferably, connected together by means of a spacer bar 36 which is welded to each of the lower edges of the arms, are secured to the upper surface of the pad. This can be accomplished by welding the spacer bar and the lower edges of the arms directly upon the upper surface of the pad. Alternatively, the spacer bar may be omitted and the arms welded directly to the pad in space relationship.

In order to install the skid shoe upon a snow plow, first, the plow is raised off the ground while it is mounted upon its support vehicle. Then, a pair of adjacent bolts are removed. The preformed shoe assembly is arranged with the angle bracket slots overlapping the holes from which the bolts have been removed and the bolts are replaced or else longer bolts are used to fasten the angle brackets to the moldboard.

After the shoe assembly is bolted to the plow, the plow is then lowered towards the ground until the rearmost corner of the pad touches the ground, which has been designated by the solid line 38 in FIG. 3.

Further lowering of the plow towards the ground, causes the pad to pivot around the hinge-like tabs 34. The pivoting or bending movement of the pad continues until the bottom surface 16 of the blade makes ground contact. At this point, the bottom surface 31 of the pad is arranged in full face to face contact which may involve some longitudinal twisting or movement, both in the lengthwise and transverse directions until the pad is in parallelism with the bottom surface 16 of the blade.

Once the pad is in alignment with the blade as shown, for example, in FIG. 4, the shoe assembly may be removed from the plow by releasing the nuts 14 and removing the bolts 15. The stiff tabs maintain the angular relationships between the brackets and the pad. However, to avoid any subsequent misalignment, it is preferable to tack weld the adjacent arm and bracket parts before removing the assembly from the moldboard. Such tack welding involves merely putting in a sufficient, short length of weld to insure that the parts will not move upon disassembly from the moldboard.

After the assembly is removed from the moldboard, the adjacent arms 35 and bracket legs 23 are welded together. As shown in FIG. 1, the welds 40 and 41 secure the upper edges of the arms to the adjacent second legs 23. In addition, a weld line 42 is preferably applied to the adjacent edges of the pad and bracket attachment legs 22 (see FIG. 1). Once the welding is completed, the pad is custom angled for its particular plow blade and a sturdy rigid unit is completed and ready for reassembly back on the plow blade for use.

Where a new plow blade 12*a* is used, as illustrated in FIG. 5, an additional step is required in order to align the pad with the blade lower edge. That is, a new blade usually has a squared lower edge 44 (see FIG. 5) so that a rear corner 45 first engages the ground. After the blade is used for some while, the ground engaging corner is worn off and an angular surface 16*a* is formed similar to that described above.

In order to permit the initial wear of the corner 45 of the blade, a shim 47 is arranged under the pad 30 during the step of lowering the blade into ground engaging position in order to set the angle of the pad relative to the brackets. The shim may be formed of a plate of a thickness corresponding to the expected wear of the corner 45 of the blade 12*a*.

In the assembly shown in FIG. 5, the plow is initially used for sufficient periods of time to wear away the corner 45 until the pad is in parallel alignment with the worn edge 16*a* formed on the bottom of the blade, at which point, the operation is the same as the described above.

Having fully described an operative embodiment of this invention, I now claim:

1. A level adjustable skid shoe initially attached upon a plow moldboard while being capable of adjustment into a working position, and said moldboard having a forward face and a rear face, with an elongated, plate-like blade fastened upon one of said faces and extending beneath the moldboard, and with the blade lower edge forming an elongated, narrow ground engaging bottom surface, said skid shoe comprising:

a bracket having a first leg adapted for fastening upon one face of the moldboard, and a second leg extending angularly away from the first leg, said first leg having a lower edge portion;

a generally horizontally arranged, plate-like wear pad means having a generally flat, lower, ground engaging, wear resistant face;

means for initially holding the wear pad means roughly normal to the first leg and the blade, with said wear pad means having an edge roughly parallel to the first leg lower edge portion, said holding means including bendable connector means for fastening one edge of the wear pad means to the lower edge portion of the bracket first leg;

said wear pad means being pivotable into a level working position by bending of said bendable connecting means wherein its face is both longitudinally and transversely substantially parallel with the blade bottom surface, with the connector means holding the pad in such position;

means for maintaining said wear pad means in a level working position, said maintaining means including an arm having a lower end portion fastened to the pad and upper end portion arranged closely adjacent the bracket second leg and being welded thereto after the pad has been arranged in its level working position.

2. A skid shoe as defined in claim 1, and including a second similar bracket adapted for fastening to the moldboard in spaced relationship to the first mentioned bracket with said wear pad means extending between and beneath both brackets and said pad edge being initially secured by said connector means to the second bracket, and likewise, said pad having a second arm secured to it and welded to the second bracket.

3. A skid shoe as defined in claim 2, and said pad one edge being welded to the lower edge portions of each of the first legs of the brackets when the arms are welded to the bracket second legs.

4. The invention as defined in claim 1 wherein said connector means is a stiff bendable tab.

5. The invention as defined in claim 2 wherein said connector means is a plurality of stiff bendable tabs.

6. The invention as defined in claim 1 wherein said moldboard includes pre-existing bolt holes for securing said plow thereto and said bracket including an aperture to be aligned with said pre-existing bolt holes for securing said shoe to said moldboard.

7. A method of leveling a skid shoe ground engaging pad surface into parallelism with the ground engaging bottom edge surface of the lower edge of a plow blade fastened upon a plow moldboard comprising essentially the steps of:

(a) forming a skid shoe assembly with an angle bracket having an upright first leg and an angularly arranged second leg, and with a wear pad having a lower ground engaging face, with the pad having an edge secured to the lower edge of the first leg by an adjustable bendable connector means, and with the pad arranged beneath the second leg and having an arm connected to the pad and located adjacent the second leg;

(b) mechanically fastening the bracket first leg to the plow moldboard and using said connector means for initially holding the pad roughly normal to the first leg and the blade, with the pad edge being arranged roughly in alignment with the lower edge of the plow blade;

(c) adjusting and pivoting the pad by bending said adjustable bendable connector means until the lower face of the pad is arranged in a level working position in full face to face contact with the ground and, therefore, said pad is substantially longitudinally and transversely parallel to the blade bottom, ground engaging surface and said connector means holding said pad in the level working position;

(d) thereafter welding the arm to the bracket second leg for securely maintaining said pad in the level working position.

8. The method as defined in claim 7 wherein said step of adjusting said pad and the adjustable connector means includes lowering the plow until the blade bottom edge surface engages the ground so that pressure between the pad and ground during the lowering pivots the pad and the connector means relative to each other.

9. A method as defined in claim 7 wherein said moldboard includes pre-existing bolt holes for receiving bolts to secure said plow to said moldboard and said step of mechanically fastening the bracket first leg to the plow moldboard includes fastening said bracket at said pre-existing bolt holes.

10. A method as defined in claim 7 wherein the blade and moldboard each have a rear surface which is normally arranged at an acute angle relative to the ground, with the blade lower edge surface being initially at a generally right angle relative to the blade rear surface, so that only a corner of the blade formed by the intersection of the blade bottom and rear surfaces initially contacts the ground until that corner is worn down after a period of rubbing against the ground during use of the plow, to then form a blade bottom surface at an obtuse angle relative to the blade rear face; and including the step of placing a shim below the pad and the lower edge of said bracket first leg with the shim having a thickness corresponding to the height of the blade, at the corner which initially contacts the ground, which is expected to be worn down, so that the pad lower face is arranged in parallelism with the expected, that is, the worn blade bottom surface.

* * * * *